US005953569A

United States Patent [19]

Ishikawa

[11] Patent Number: 5,953,569

[45] Date of Patent: Sep. 14, 1999

[54] TONER SUPPLY ROLLER FOR USE IN IMAGE FORMING DEVICE

[75] Inventor: Satoru Ishikawa, Nagoya, Japan

[73] Assignee: Brother Kogyo Kabushiki Kaisha, Nagoya, Japan

[21] Appl. No.: 09/166,928

[22] Filed: Oct. 6, 1998

[30] Foreign Application Priority Data

Oct. 8, 1997 [JP] Japan ..... 9-275567

[51] Int. Cl.[6] ..... G03G 15/08

[52] U.S. Cl. ..... 399/281; 399/286

[58] Field of Search ..... 399/281, 286, 399/279, 272; 492/53

[56] References Cited

U.S. PATENT DOCUMENTS 5,287,150 2/1994 Kinoshita et al. ..... 399/281
5,594,198 1/1997 Ikeda et al. ..... 399/281
5,655,197 8/1997 Okada et al. ..... 399/281
5,768,668 6/1998 Shiraki et al. ..... 399/281
5,812,918 9/1998 Nakaue et al. ..... 399/281 X

FOREIGN PATENT DOCUMENTS

A-7-36273 2/1995 Japan .

*Primary Examiner*—Robert Beatty
*Assistant Examiner*—Sophia S. Chen
*Attorney, Agent, or Firm*—Oliff & Berridge, PLC

[57] ABSTRACT

The toner supply roller 31 includes a roller shaft 31A made of metal, an inner spongy member 31B formed around the roller shaft 31A, and an outer spongy member 31C formed around the inner spongy member 31B. The inner spongy member 31B is formed of a closed cell foam material having electrically conductive properties. On the other hand, the outer spongy member 31C is formed of an open cell foam material having electrically conductive properties. Therefore, toner particles will not enter the cells formed in the inner spongy member 31B even after the toner supply roller 31 has been used for a long time.

12 Claims, 4 Drawing Sheets

TONER SUPPLY ROLLER FOR USE IN IMAGE FORMING DEVICE

BACKGROUND OF THE INVENTION

1. Field of the Invention

The present invention relates to a toner supply roller for use in an image forming device, and more specifically to a developing roller including two spongy layers on its surface.

2. Description of Related Art

There has been proposed a develop unit for use in an image forming device, such as a laser printer. The develop unit includes a developing roller and a supply roller for stably and continuously supplying toner particles to the developing roller. The supply roller is usually formed from a spongy foam material. However, toner can enter the spongy foam material, so that the supply roller hardens undesirably.

Japanese Patent-Application Publication (Kokai) No. HEI-7-36273 discloses a configuration that prevents the supply roller from becoming undesirably hard. The disclosed toner supply roller has an inner layer, a middle layer, and an outer layer. Both the inner layer and the outer layer are formed from an open cell foam spongy member. However, cell density of the outer layer is smaller than that of the inner layer. The outer layer is formed with a low cell density. Therefore, there are few openings at the outer layer of the supply roller for toner particles to enter through. Further, even if toner particles enter the outer layer, few paths are available for the toner particles to reach the inner layer. Therefore, at least the inner layer remains soft, so that the toner supply roller can be maintained soft at its surface.

The middle layer is provided between the inner layer and the outer layer for further preventing toner particles from entering the inner layer through the outer layer. Any toner particles that happen to work the way through the outer layer will be blocked by the middle layer from entering the inner layer. However, providing the additional middle layer between the inner layer and the outer layer increases manufacturing costs, and also complicates processes for producing the develop unit.

SUMMARY OF THE INVENTION

It is an objective of the present invention to overcome the above problems and to provide a supply roller having inner and outer layers both formed from a spongy, wherein toner particles can be prevented from entering the inner layer without provision of a middle layer between the inner layer and the outer layer.

In order to achieve the above and other objectives, there is provided a developing unit for use an image forming device. The developing unit includes a photosensitive member, a supply roller and a developing roller. The photosensitive member has a photosensitive surface on which an electrostatic latent image is formed when exposed to imaging light. The supply roller is rotatable and supplies toner particles. The developing roller rotatably contacts both the supply roller and the photosensitive member. The developing roller receives the toner particles from the supply roller and supplies the toner particles to the photosensitive member. The toner particles supplied to the photosensitive member develop the electrostatic latent image formed on the photosensitive surface of the photosensitive member into a toner image. The supply roller is a double layer structure having an inner peripheral layer and an outer peripheral layer. The inner peripheral layer is formed from a closed cell foam spongy member. The outer peripheral layer is formed from a closed cell foam spongy member.

There is also provided an image forming device including a recording medium supplying unit, an exposure unit, a photosensitive drum, a supply roller, a developing roller, a transfer unit, and a fixing unit. The recording medium supplying unit supplies a recording medium. The exposure unit generates image light based on image data. The photosensitive member has a photosensitive surface on which an electrostatic latent image is formed when exposed to the imaging light generated by the exposure unit. The supply roller is rotatable and supplies toner particles. The developing roller rotatably contacts both the supply roller and the photosensitive member. The developing roller receives the toner particles from the supply roller and supplies the toner particles to the photosensitive member. The toner particles supplied to the photosensitive member develop the electrostatic latent image formed on the photosensitive surface of the photosensitive member into a toner image. The transfer unit transfers the toner image on the photosensitive surface of the photosensitive member to the recording medium supplied by the recording medium supply unit. The fixing unit thermally fixes the toner image transferred on the recording medium onto the recording medium. The supply roller is a double layer structure having an inner peripheral layer and an outer peripheral layer. The inner peripheral layer is formed from a closed cell foam spongy member. The outer peripheral layer is formed from a closed cell foam spongy member.

BRIEF DESCRIPTION OF THE DRAWINGS

The particular features and advantages of the invention as well as other objects will become more apparent from the following description taken in connection with the accompanying drawings, in which:

FIG. 3(*b*) is a cross-sectional view of an open cell foam spongy member of the develop unit shown in FIG. 1.

DETAILED DESCRIPTION OF THE PREFERRED EMBODIMENT

A supply roller for use in an image forming device according to a preferred embodiment of the present invention will be described while referring to the accompanying drawings. In the following description, the expressions "front", "rear", "upper", "above", and "beneath" are used throughout the description to define the various parts when the image forming device is disposed in an orientation in which it is intended to be used. In the present embodiment, a laser printer is used as example of the image forming device in which the supply roller of the present embodiment is used.

Figure 1:
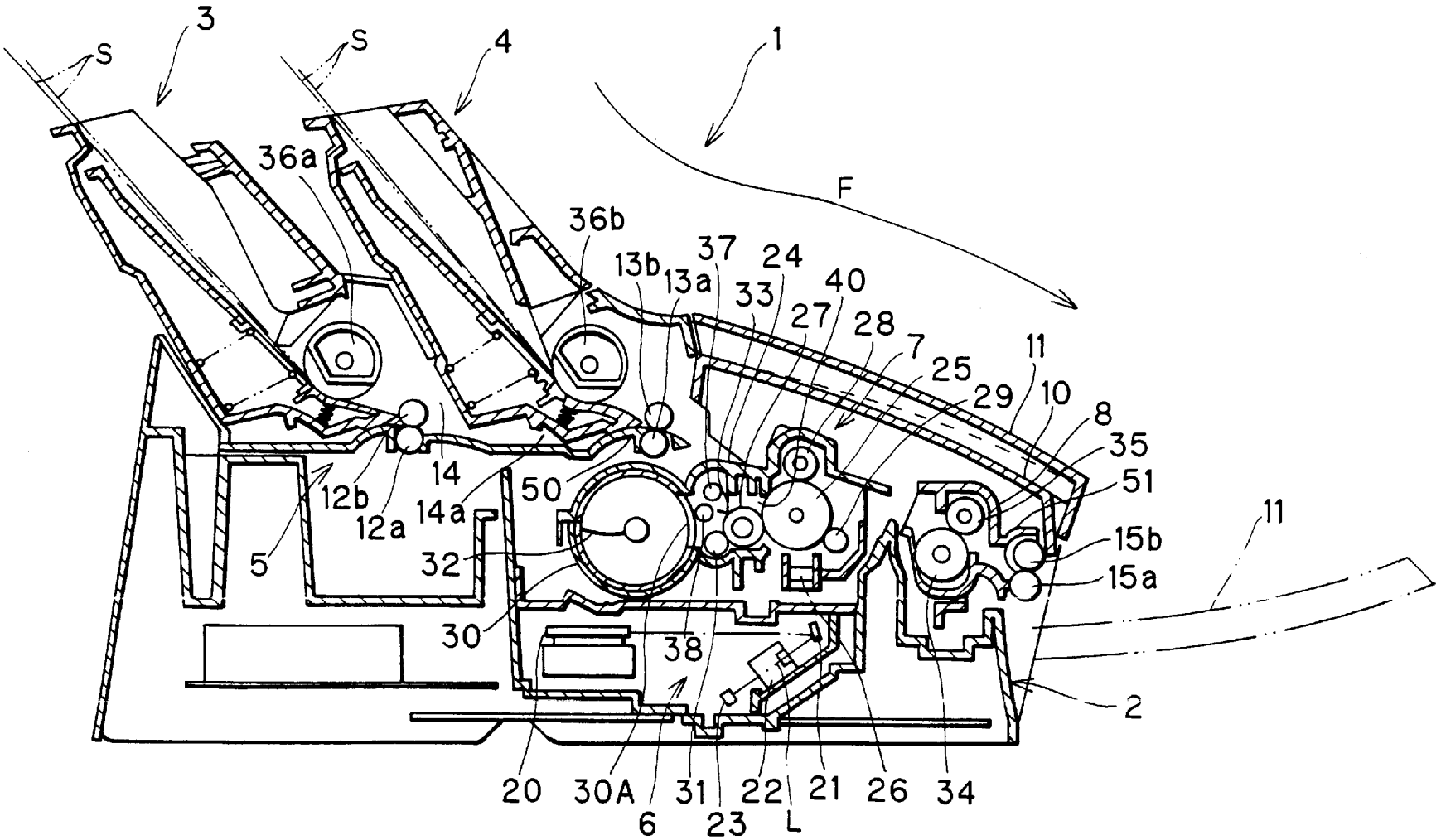
FIG. 1 is a cross-sectional view showing a laser printer including a develop unit according to an embodiment of the present invention.

As shown in FIG. 1, a laser printer 1 includes a main case 2, a first sheet tray 3, a second sheet tray 4, a sheet feed mechanism 5, a scanner unit 6, a process unit 7, a fixing unit 8, a top cover 10, and a discharge tray 11. The first and second sheet trays 3, 4 are disposed at a rear end portion of the main case 2. The sheet feed mechanism 5 is disposed downstream from the first and second sheet trays 3, 4 in a sheet feed direction indicated by an arrow F. The process unit 7 and the fixing unit 8 are also disposed downstream from the sheet feed mechanism 5 in the sheet feed direction F in this order. The scanner unit 6 is disposed beneath the process unit 7. The scanner unit 6, the process unit 7, and the fixing unit 8 together serve as a print mechanism of the laser printer 1.

The top cover 10 is provided at an upper front end portion of the main case 2. The discharge tray 11 is pivotably movably supported at the upper front end of the main case 2 so that the discharge tray 11 can pivot toward and lean against the main case 2 when not in use. Although not shown in the drawings, the laser printer 1 further includes a driving mechanism for driving the sheet feed mechanism 5. The driving mechanism is housed in the main case 2 at its left side portion.

Next, detailed description of each component of the laser printer 1 will be provided. The first sheet tray 3 is fixedly mounted at the upper rear end portion of the main case 2. The second sheet tray 4 is detachably mounted on the main case 2 in front of the first sheet tray 3. A plurality of recording media, such as recording sheets S, are mounted on the first and second sheet trays 3, 4 in a stacked fashion.

The sheet feed mechanism 5 is provided for feeding a recording sheet S selectively from the first and second sheet trays 3, 4, and for supplying the recording sheet S to the process unit 7. The sheet feed mechanism 5 includes pickup rollers 36*a*, 36*b*, a pair of feed rollers 12*a*, 12*b*, a pair of registration rollers 13*a*, 13*b*, and a sheet detect sensor 50. The pickup rollers 36*a*, 36*b* are provided above the first and second sheet trays 3, 4, respectively, for feeding an uppermost recording sheet S in the sheet feed direction F. The feed rollers 12*a*, 12*b* are provided near a front end of the first sheet tray 3. The registration rollers 13*a*, 13*b* are provided near a front end of the second sheet tray 4. The feed roller 12*a* and the registration roller 13*a* are driven to rotate by motors (not shown). The feed roller 12*a* and the registration roller 13*a* rotate the feed roller 12*b* and the registration roller 13*b*, respectively. The sheet detect sensor 50 is provided near a center of the registration roller 13*a*.

With this configuration, a recording sheet S mounted on the first sheet tray 3 Is picked up by the pickup roller 36*a* and fed out by the pair of the rollers 12*a*, 12*b* until it reaches the registration rollers 13*a*, 13*b*. On the other hand, a recording sheet S mounted on the second sheet tray 4 is picked up by the pickup roller 36*b* and fed directly to the registration rollers 13*a*, 13*b*. When the recording sheet S reaches the registration rollers 13*a*, 13*b*, it is detected by the sheet detect sensor 50, and registration is performed by the registration rollers 13*a*, 13*b*. Then the recording sheet S is further transported toward the process unit 7.

A sheet feed path 14 is defined from the first sheet tray 3 to the registration rollers 13*a*, 13*b*. The sheet feed path 14 includes a lower portion 14*a* which extends along a lower surface of the second sheet tray 4. When the second sheet tray 4 is dismounted from the main case 2, the lower portion 14*a* of the sheet feed path 14 is exposed to outside of the main case 2.

The scanner unit 6 includes a laser generating unit (not shown), a polygon mirror 20, reflection mirrors 21, 23, and a lens 22. The laser generating unit generates a laser beam based on an image signal. As indicated by a dotted line L in FIG. 1, the laser beam generated from the laser generating unit travels via the polygon mirror 20, the reflection mirror 21, the lens 22, and the reflection mirror 23, and reaches a uniformly charged photosensitive peripheral surface of a photosensitive drum 25 (to be described later). As the laser beam scans at a high speed across the peripheral surface of the photosensitive drum 25, an electrostatic latent image corresponding to the image signal is formed on the peripheral surface of the photosensitive drum 25.

Figure 2:
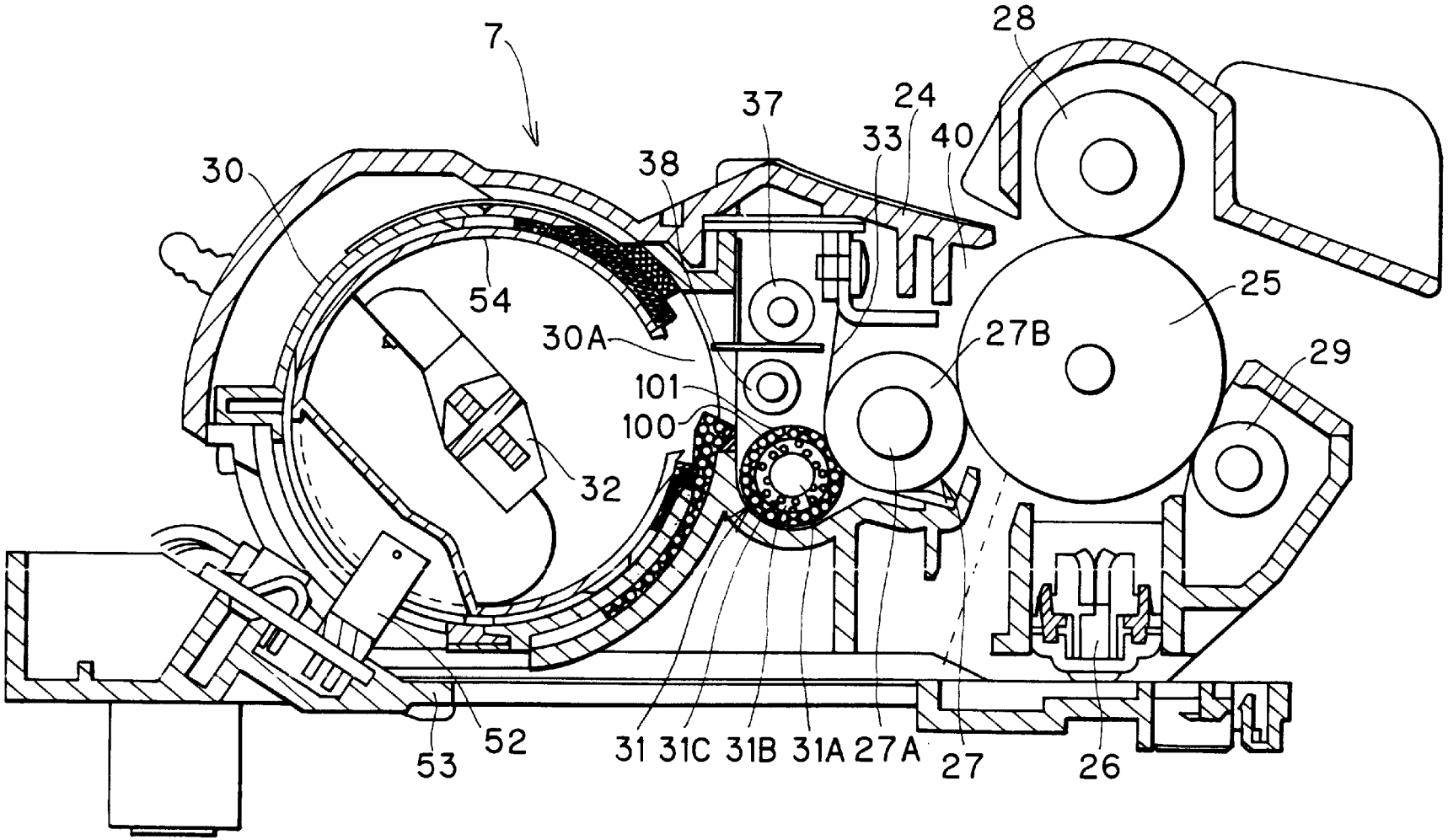
FIG. 2 is a partial cross-sectional view of the laser printer shown in FIG. 1.

As shown in FIGS. 1 and 2, the process unit 7 includes the photosensitive drum 25, a scorotoron charge unit 26, a developing roller 27, a transfer roller 28, a cleaning roller 29, a toner box 30, a toner sensor 52, a toner supply roller 31, a pair of auger rollers 37, 38, and a case 24. The case 24 houses other components of the process unit 7 and defines a develop chamber 40. The photosensitive drum 25 and the transfer roller 28 are rotatably disposed in contact with each other. The recording sheet S transported by the registration rollers 13*a*, 13*b* is supplied between the photosensitive drum 25 and the transfer roller 28, and further transported toward the fixing unit 8. The photosensitive drum 25 has a photosensitive peripheral surface. The charge unit 26 is provided for uniformly charging the peripheral surface of the photosensitive drum 25. As described above, when the uniformly charged peripheral surface of the photosensitive drum 25 is exposed to the laser beam from the laser unit, an electrostatic latent image is formed on the peripheral surface.

The toner supply roller 31 and the developing roller 27 are rotatably provided at a lower position within the develop chamber 40 in confrontation with each other. The toner box 30 is formed with a port 30A and detachably houses a toner cartridge 54. The toner cartridge 54 stores toner particles and includes an agitator 32 for agitating the toner particles within the toner cartridge 54. When the toner particles in the toner cartridge 54 run out, the toner box 30 is taken out of the case 24. Then, the toner cartridge 54 is replaced with a new toner cartridge 54, and the toner box 30 is returned into the main case 2.

The toner sensor 52 is provided for detecting the remaining amount of the toner particles within the toner cartridge 54. Although not shown in the drawings, the toner sensor 52 includes a light emitting diode (LED) and a photosensor, and is positioned beneath the toner cartridge 54 so that the LED and the photosensor face each other through a portion of the toner cartridge 54. The toner sensor 52 is attached to a circuit substrate by soldering at a center lower portion of the toner box 30 and also to the scanner cover 53 by a screw. The toner sensor 52 detects the remaining amount of toner particles within the toner cartridge 54 by detecting an amount of light transmitted between the LED and the photosensor through the portion of the toner cartridge 54.

The toner particles are supplied from the toner cartridge 54 through the port 30A into the main case 2. The pair of auger rollers 37, 38 are provided for evenly dispersing the toner particles within the case 24. Rotation of the toner supply roller 31 supplies the toner particles to the developing roller 27. The blade 33 presses against the developing roller 27 to regulate the amount of the toner particles on the developing roller 27 to a uniform thickness. As the developing roller 27 rotates, the toner particles are further transported toward the photosensitive drum 25.

Then, the toner particles selectively adhere onto the peripheral surface of the photosensitive drum 25, thereby developing the electrostatic latent image into a toner image. The toner image is then transferred onto the recording sheet S passing between the photosensitive drum 25 and the transfer roller 28. The recording sheet S with the toner image formed thereon is transported toward the fixing unit 28.

Toner particles which have not been transferred onto the recording sheet S are further transported on the photosensitive drum 25 and collected by the cleaning roller 29.

The fixing unit 8 includes a heat roller 34, a pressing roller 35, a pair of discharge rollers 15*a*, 15*b*, and a discharge sensor 51. The heat roller 34 generates heat, and the pressing roller 35 presses against the heat roller 34. The pair of the discharge rollers 15*a*, 15*b* are provided downstream from the pressing roller 35 in the sheet feed direction F. The discharge sensor 51 is provided adjacent to the discharge roller 15*a* substantially at a center of the discharge roller 15*a*.

When the recording sheet S with the toner image formed thereon is supplied between the heat roller 34 and the pressing roller 35, the toner image is thermally fixed onto the recording sheet S. Then, the recording sheet S is fed by the pair of the discharge rollers 15*a*, 15*b* and discharged out of the main case 2 onto the discharge tray 11. At this time, the discharge sensor 51 detects discharging of the recording sheet S.

It should be noted that the recording sheet S is fed along the sheet feed path 14 at a speed equal to or faster than rotational speed of the heat roller 34, the pressing roller 35, and the discharge rollers 15*a*, 15*b*. Otherwise, the toner image on the photosensitive drum 25 may not be transferred onto an appropriate position of the recording sheet S, so that the toner image is garbled.

Next, the toner supply roller 31 will be described in detail while referring to FIGS. 2, 3(*a*), and 3(*b*). The toner supply roller 31 includes a roller shaft 31A, an inner spongy member 31B, and an outer spongy member 31C. The roller shaft 31A is made from metal, such as steel. The inner spongy member 31B covers the roller shaft 31A and is made from a closed cell foam spongy, such as an electrically conductive silicon rubber spongy. The outer spongy member 31C is covered over the inner spongy member 31B and made from an open cell foam spongy, such as electrically conductive urethane foamed spongy. The developing roller 27 includes a roller shaft 27A and an electrically conductive rubber member 27B. The roller shaft 27A is formed from a metal, such as steel, and covered with the rubber member 27B. Usually, the rubber member 27B has a hardness greater than a hardness of the outer spongy member 31C. Therefore, the inner and outer spongy members 31B, 31C of the toner supply roller 31 are deformed by pressing against the rubber member 27B of the developing roller 27.

Figure 3A:
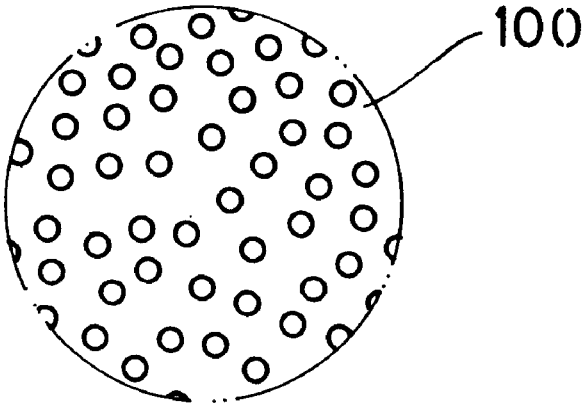
FIG. 3(*a*) is a cross-sectional view of a closed cell foam spongy member of the develop unit shown in FIG. 1.
Figure 3B:
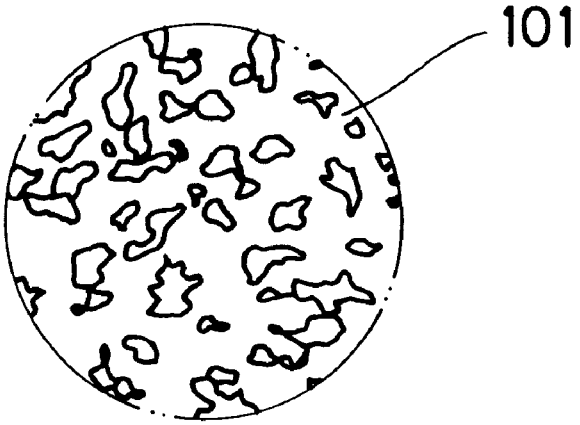

As shown in FIG. 3(*b*), the outer spongy member 31C is formed with a plurality of open cells 101. That is, the cells 101 are not separate from each other, but are connected with each other. Therefore, when toner particles are supplied onto a surface of the outer spongy member 31C, the toner particles gradually enter the outer spongy member 31C and harden the outer spongy member 31C. However, because the toner particles uniformly enters the outer spongy member 31C from its surface, uniform hardness of the surface of the spongy member 31 can be maintained. On the other hand, as shown in FIG. 3(*a*), the inner spongy member 31B is formed with a number of closed cells 100. That is, all cells 100 are separate and isolated from the surrounding cells 100. With this configuration, even when toner particles are supplied onto a surface of the inner spongy member 31B, the toner particles will not enter the inner spongy member 31B. Therefore, the inner spongy member 31B stays soft for a long time. In this way, the toner supply roller 31 can be maintained soft.

Figure 4:
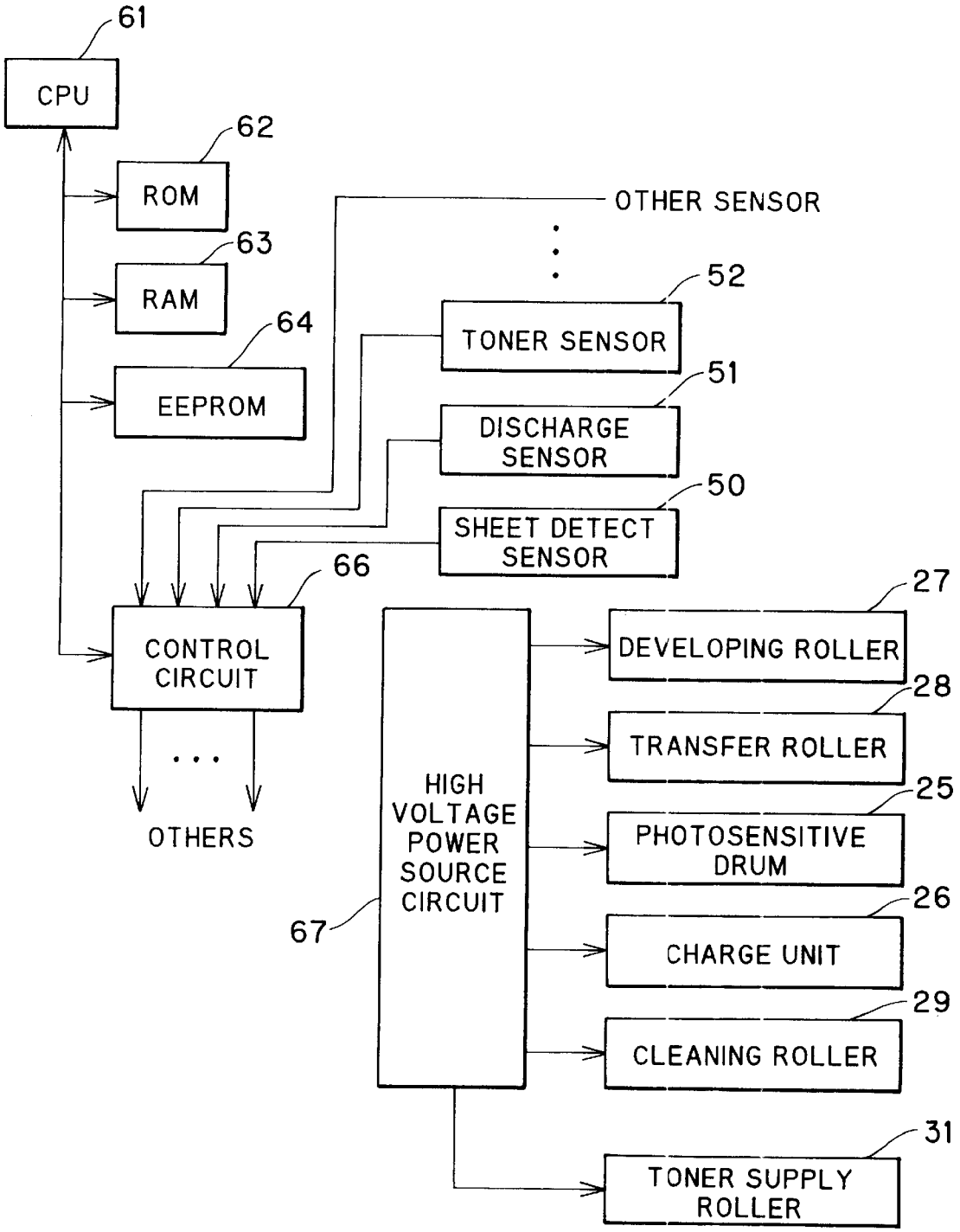
FIG. 4 is a block diagram showing a control unit and other component of the laser printer of FIG. 1.

Next, a control configuration of the process unit 7 will be described while referring to FIG. 4. As shown in FIG. 4, the process unit 7 includes a central processing unit (CPU) 61, a read only memory (ROM) 62, a random access memory (RAM) 63, an electrically erasable and programmable read only memory (EEPROM) 64, an application specific integrated circuit (ASIC) (not shown), and a control circuit 66. The ROM 62 stores control programs, and the RAM 63 stores various data. The EEPROM 64 stores counter values of various counters (not shown). The CPU 61 controls the components of the laser printer 1. For example, the CPU 61 controls the control circuit 66 based on detection results from various sensors and on the control programs stored in the ROM 62.

The control circuit 66 is connected to the sheet detect sensor 50, the discharge sensor 51, the toner sensor 52, and a high voltage power source circuit 67. The high voltage power source circuit 67 is further connected to the developing roller 27, the transfer roller 28, the photosensitive drum 25, the charge unit 26, the cleaning roller 29, and the toner supply roller 31 for supplying a high bias voltage to these components.

In this embodiment, the high voltage power source circuit 67 supplies a predetermined bias DC voltage of 700V to the roller shaft 27A of the developing roller 27 and a voltage of 800V to the roller shaft 31A of the toner supply roller 31. As a result, an electrical field is generated between the developing roller 27 and the toner supply roller 31. Also, because both the inner and outer spongy members 31B, 31C are electrically conductive, an electrical charge applied to the toner particles on the toner supply roller 31 can be stabilized in uniform. Then, the positively charged toner particles on the toner supply roller 31 are electrically attracted toward the developing roller 27. In this way, toner particles on the toner supply roller 31 can be reliably supplied onto the developing roller 27.

According to the above-described embodiment, toner particles which are accumulated in the outer spongy member 31C can be prevented from entering the inner spongy member 31B. Therefore, the inner spongy member 31B can be maintained soft even after the toner supply roller 31 has been used for a long time. As a result, a high quality image can be formed all the time.

While the invention has been described in detail with reference to specific embodiments thereof, it would be apparent to those skilled in the art that various changes and modifications may be made therein without departing from the spirit of the invention, the scope of which is defined by the attached claims.

For example, the process unit 7 can include an endless-belt-shaped photosensitive member instead of the photosensitive drum 25.

Also, negatively charged toner particles can be used instead of the positively charged toner particles. In this case, the toner supply roller 31 is supplied with a bias voltage such that the negatively charged toner particles are attracted to the developing roller 27.

Further, in the above-described embodiment, a direction in which the cells of the outer spongy member 31C are opened is not specified. However, the cells can be opened in a specific direction, for example, in the longitudinal direction of the toner supply roller 31.

What is claimed is:

1. A developing unit for an image forming device comprising:

a photosensitive member having a photosensitive surface on which an electrostatic latent image is formed when exposed to imaging light;

a supply roller that is rotatable and supplies toner particles; and a developing roller that rotatably contacts both the supply roller and the photosensitive member, the developing roller receiving the toner particles from the supply roller and supplying the toner particles to the photosensitive member, the toner particles supplied to the photosensitive member developing the electrostatic latent image formed on the photosensitive surface of the photosensitive member into a toner image; wherein the supply roller is a double layer structure having an inner peripheral layer and an outer peripheral layer, the inner peripheral layer being formed from a closed cell foam spongy member, the outer peripheral layer being formed from an open cell foam spongy member.

2. The developing unit according to claim 1, wherein the inner peripheral layer and the outer peripheral layer of the supply roller have electrically conductive properties.

3. The developing unit according to claim 2, further comprising a control unit that applies a first voltage to the developing roller and a second voltage to the supply roller, the first voltage and the second voltage developing an electrical field between the developing roller and the supply roller.

4. The developing unit according to claim 3, wherein the toner particles are electrically charged, the electrical field generated between the developing roller and the supply roller attracts the toner particles to the developing roller from the supply roller.

5. The developing unit according to claim 1, wherein the inner peripheral layer is formed from a silicon rubber spongy, and the outer peripheral layer is formed from an urethane foamed spongy.

6. The developing unit according to claim 1, wherein the outer peripheral layer of the supply roller has a surface hardness, and the developing roller has a roller body formed from an electrically conductive rubber member, the roller body having a surface hardness greater than the surface hardness of the outer peripheral layer of the supply roller.

7. An image forming device comprising:

a recording medium supplying unit that supplies a recording medium;

an exposure unit that generates image light based on image data;

a photosensitive member having a photosensitive surface on which an electrostatic latent image is formed when exposed to the imaging light generated by the exposure unit;

a supply roller that is rotatable and supplies toner particles;

a developing roller that rotatably contacts both the supply roller and the photosensitive member, the developing roller receiving the toner particles from the supply roller and supplying the toner particles to the photosensitive member, the toner particles supplied to the photosensitive member developing the electrostatic latent image formed on the photosensitive surface of the photosensitive member into a toner image;

a transfer unit that transfers the toner image on the photosensitive surface of the photosensitive member to the recording medium supplied by the recording medium supplying unit; and a fixing unit that thermally fixes the toner image transferred on the recording medium onto the recording medium; wherein the supply roller is a double layer structure having an inner peripheral layer and an outer peripheral layer, the inner peripheral layer being formed from a closed cell foam spongy member, the outer peripheral layer being formed from an open cell foam spongy member.

8. The image forming device according to claim 7, wherein the inner peripheral layer and the outer peripheral layer of the supply roller have electrically conductive properties.

9. The image forming device according to claim 8, further comprising a control unit that applies a first voltage to the developing roller and a second voltage to the supply roller, the first voltage and the second voltage developing an electrical field between the developing roller and the supply roller.

10. The image forming device according to claim 9, wherein the toner particles are electrically charged, the electrical field generated between the developing roller and the supply roller attracts the toner particles to the developing roller from the supply roller.

11. The image forming device according to claim 7, wherein the inner peripheral layer is formed from a silicon rubber spongy, and the outer peripheral layer is formed from an urethane foamed spongy.

12. The image forming device according to claim 7, wherein the outer peripheral layer of the supply roller has a surface hardness, and the developing roller has a roller body formed from an electrically conductive rubber member, the roller body having a surface hardness greater than the surface hardness of the outer peripheral layer of the supply roller.

* * * * *